United States Patent [19]

Penalba

[11] Patent Number: 4,658,749

[45] Date of Patent: Apr. 21, 1987

[54] AUTONOMOUS STATION FOR CLEANING THE HULLS OF PLEASURE CRAFT

[76] Inventor: Charles L. Penalba, 157 avenue Ste Marguerite, 06200 Nice, France

[21] Appl. No.: 863,826

[22] Filed: May 12, 1986

Related U.S. Application Data

[63] Continuation of Ser. No. 672,875, Nov. 19, 1984, abandoned.

[30] Foreign Application Priority Data

Dec. 1, 1983 [FR] France ..... 83 19436

[51] Int. Cl.[4] ..... B63B 59/10

[52] U.S. Cl. ..... 114/222; 104/118; 134/172; 405/12; 15/1.7

[58] Field of Search ..... 114/222, 45, 46, 47, 114/48, 312, 313, 322, 331, 332; 15/1.7; 134/172, 174; 105/153; 104/93, 109, 118, 124; 405/12

[56] References Cited

U.S. PATENT DOCUMENTS

| | | | |
|---|---|---|---|
| 681,562 | 8/1901 | Middleton | 114/222 |
| 702,965 | 6/1902 | Kaucher | 114/222 |
| 724,368 | 3/1903 | Wood | 104/124 |
| 732,082 | 6/1903 | Johnson | 114/222 |
| 872,888 | 12/1907 | Becchi et al. | 114/330 |
| 1,349,578 | 8/1920 | Neeper | 114/312 |
| 1,415,661 | 5/1922 | Lemon | 114/312 |
| 1,456,386 | 5/1923 | Lee | 114/222 |
| 1,468,646 | 9/1923 | Overall | 114/222 |
| 2,183,758 | 12/1939 | Walker | 104/93 |
| 3,120,197 | 2/1964 | Cirami | 104/93 |
| 3,911,849 | 10/1975 | Hammelmann | 114/222 |
| 4,375,451 | 3/1983 | Seligman et al. | 114/222 |
| 4,502,407 | 3/1985 | Stevens | 114/222 |

FOREIGN PATENT DOCUMENTS

| | | | |
|---|---|---|---|
| 998491 | 1/1952 | France | 405/12 |
| 2352595 | 1/1978 | France | 134/172 |
| 1294011 | 10/1972 | United Kingdom | 114/222 |

*Primary Examiner*—Trygve M. Blix
*Assistant Examiner*—Thomas J. Brahan
*Attorney, Agent, or Firm*—Young & Thompson

[57] ABSTRACT

An autonomous and semi-submerged station for cleaning the hulls of pleasure craft, comprising a floating ballasted pontoon or a wharf and principally a mobile cabin, ballasted, in unbreakable transparent material, with an open roof, having on its forward wall (40) two openings provided with sealed rotary bearings (1) by which enter and exit, while sweeping, tubes (2) for water under pressure fed with fresh or salt water through an autonomous pump. The work is performed under visual surveillance. Secured to the cabin, a mechanism of pulley and externally grooved wheels, controlled from the interior of the cabin permits the longitudinal displacement on the tubes secured to the floating pontoon or to the wharf. The externally grooved wheels enclose the tubes that mate the cabin to the floating pontoon or to the wharf.

12 Claims, 8 Drawing Figures

FIG_1
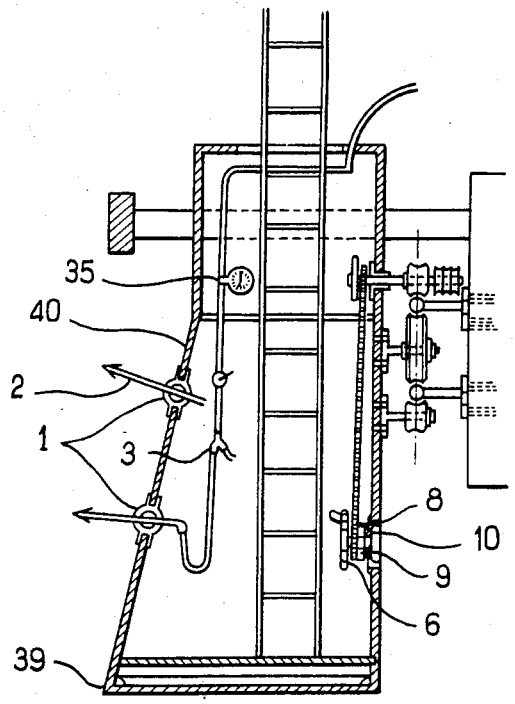
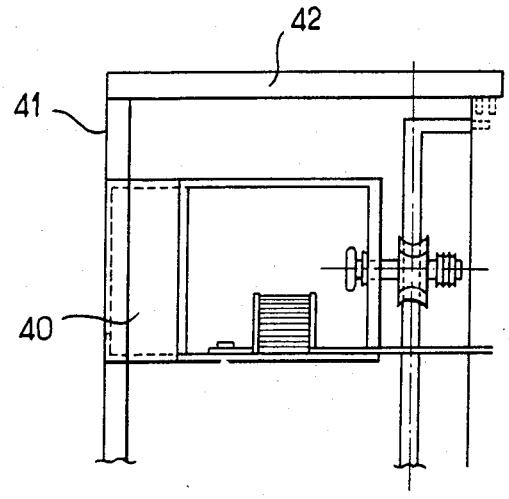
FIG_2

AUTONOMOUS STATION FOR CLEANING THE HULLS OF PLEASURE CRAFT

This application is a continuation of application Ser. No. 672,875, filed Nov. 19, 1984, now abandoned.

The present invention relates to a special mechanical technique provided for working in a marine environment. A semi-submerged autonomous station, conceived of materials with very great resistance to marine corrosion: stainless steel and transparent unbreakable plastic materials. Direct application to pleasure marinas.

The known state of the art for dealing with the problem, provides cleaning the hulls with open air mechanisms or with submerged mechanisms secured to the craft. For the latter, the cleaning is effected by non-visual rotary brushing, solely in a vertical direction.

The present invention consists of a device permitting the submerged cleaning of hulls of pleasure craft.

The traditional process consists, for cleaning, in removing the hull from the water and then subjecting it to various compressions which are harmful to the whole of the pleasure unit.

By the known process, the paint below the water line has to be restored because, having been exposed to the air, it loses all its anti-fouling properties.

The device according to the invention permits overcoming these drawbacks. It ensures complete cleaning, under visual observation, of all the submerged surfaces to be treated, by jets of fresh or salt water under pressure, from two rigid or telescopic tubes mounted on sealed rotary joints, from a mobile semi-submerged cabin of transparent unbreakable plastic material. The movement of the cabin is effected by means of a pulley, in a longitudinal direction thanks to grooved wheels confined between rails which themselves are secured to a pontoon which is preferably of reinforced concrete.

This displacement may also be effected according to the same principal on the vertical portion of a wharf.

The floating pontoon is itself immobilized in the open water by anchors actuated by means of winches. It is arranged so that a housing for the independent pump is provided, as well as a bunker or caisson and a shelter for the operators. In any case it is to be provided with a high pressure security valve, at the pump outlet. A cabin protector runs along the length of the pontoon or wharf, from bolted or sealed supports.

On the opposite side of the pontoon, the side opposite to that supporting the cabin, a securement is provided for the feed pipe of the pump; this pipe will itself be provided with two filters of stainless steel at its end, for use in open water.

The device according to the invention being adaptable to great lengths, the occupied volumes and surfaces will be such as are required.

There is given by way of non-limiting example an embodiment with reference to the accompanying drawings:

FIG. 1 shows, in cross section, the device according to the invention.

FIG. 2 shows, from above, the mobile cabin.

Figure 3:
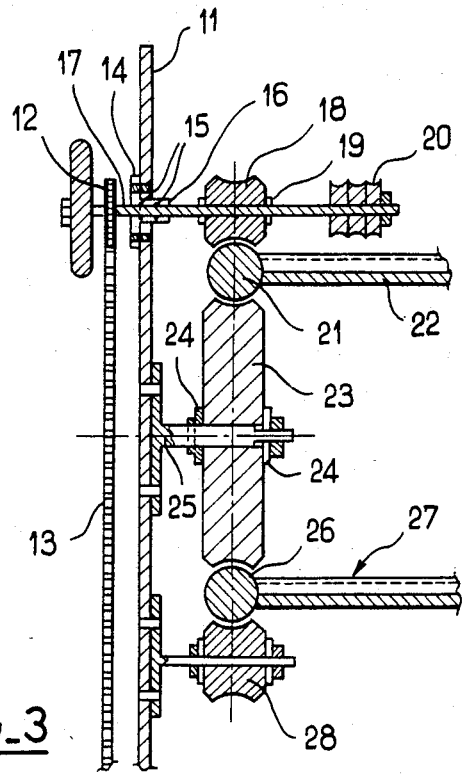
FIG. 3 shows, in cross section, the mobile mechanism.

The device comprises a mobile transparent cabin in unbreakable plastic material.

(a) On the forward wall, two openings in which are mounted two sealed rotary joints 1, traversed by two rigid or telescopic tubes 2 for water under pressure.

These pressure tubes are connected, by two flexible reinforced tubes to a T-shaped or Y-shaped coupling 3 fixed on the side wall.

Each rotary joint 1 is secured between two flanged discs 30 secured on opposite sides of the wall by bolts 31.

Between the rotary joint and the flanges, the sealing is ensured by two pierced joints (32).

In each rotary joint 1, for the passage of the tube, two internal grooves 33 serve to ereceive two O-rings.

These O-rings permit the tubes to have forward or rearward movement and ensure the sealing of the cabin.

Figure 4:
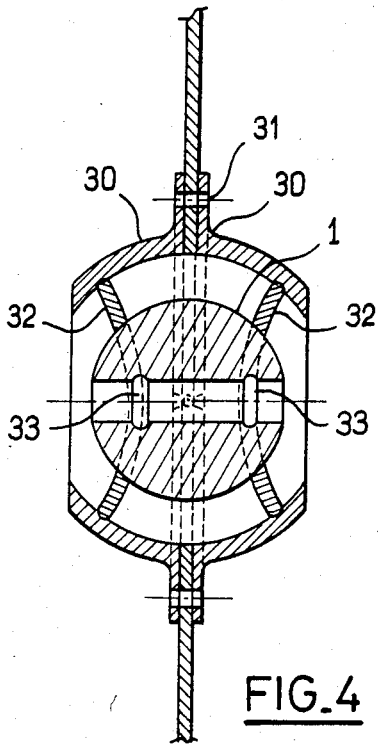
FIG. 4 shows, in section, the rotary joint of the tube.
Figure 5:
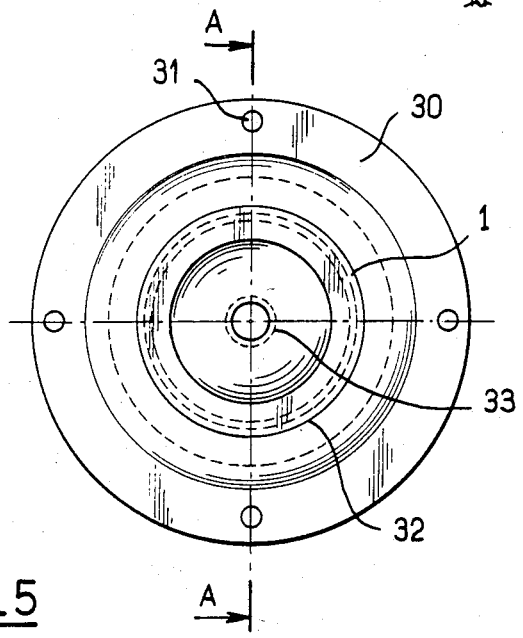
FIG. 5 shows, from the front, the rotary mounting of the tube.

FIG. 4 and FIG. 5 show the arrangement of the rotary joint, described above.

The flexible reinforced conduits 4, feeding the two pressure tubes 2, are provided at the two branches 3 of T-shape or Y-shape secured itself to another flexible reinforced conduit 7, secured on the lateral wall on which are disposed, at the height of a person, a high pressure valve 34 and about 20 cm above it, a manometer 35.

Figure 6:
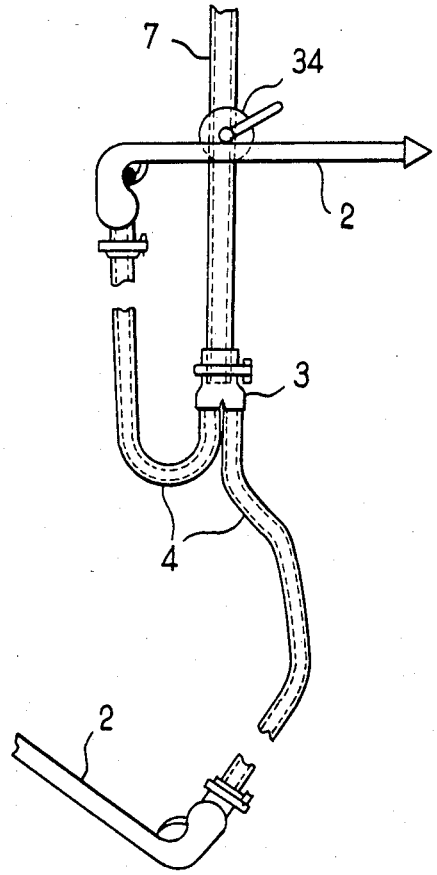
FIG. 6 shows the feed of the pressure tubes in the cabin.

FIG. 6 shows the feed set forth above.

(b) On the rear wall a movable mechanism.

To ensure the movement of the cabin forward or rearward of the vessel to be cleaned, a steering wheel 6 provided with a crank effects, by its rotating movement, the drive of a pinion 8 secured to a sleeve 9 moving on ball bearings housed on a fixed axle secured itself to a disc 10 bolted to the wall.

In FIG. 3, is shown the movable mechanism which is driven by the force exerted on the crank of the above-mentioned steering wheel 6. It is comprised as follows:

- a chain 13 is driven by rotation of pinion 8 of the crank, itself driven by the manual pressure exerted on the crank of the steering wheel 6.
- this chain 13 drives by its movements a pinion 12 on the axle of the pulley of a diameter greater than the pinion 8 of the crank.
- the pulley axle 17 passes through the rear wall 11 by a bolted fitting 14 having two internal grooves 15 in which are disposed two sealing O-rings, as well as a hole adapted to receive a lubricator 16. After having passed through wall 11 through fitting 14, the pulley axle 17 passes through a grooved wheel 18 which is freely rotatable and disposed between two abutments 19, secured by means of set screws. The pulley axle 17 has, at its end, a shoulder reducing its diameter and compensates this reduction by a secured male abutment, which serves as a guide and as the body of a pulley 20 with three external grooves. This pulley 20 covers, with its axial hole, a female slot that mates with the abutment secured to the pulley axle 17, when the pulley is slid on this axle.

The pulley axle 17 is internally screw threaded at its end to the dimension of the flange bolt, to the international gauge, which will serve as the abutment for the assembly of the pulley mechanism.

the exposed groove wheel 18, traversed by the pulley axle 17, rolls on tubing 21 secured to legs 22 secured to the pontoon, by sealing or bolting.

the tubing 21 is held by the emplacement of the second exposed groove wheel 23 which turns on a fixed axle 25 secured to a disc bolted in the wall. This grooved wheel 23 is disposed as the previous one, between two abutments 24.

The axle 25 is internally screw threaded at its end to the dimension of the flange bolt, with the international gauge, which serves as the abutment for the assembly of the mechanism of the wheel 23.

this grooved wheel 23 rolls on a second tubing 26 secured to legs 22 secured to the pontoon by cementing or bolting.

this second tubing 26 serves to adjust a third wheel 28 with an exposed groove secured on the wall according to the same principle as the grooved wheel 23. The positioning of this grooved wheel 28 permits the cabin to be totally connected to the pontoon, while at the same time being mobile.

Figure 7:
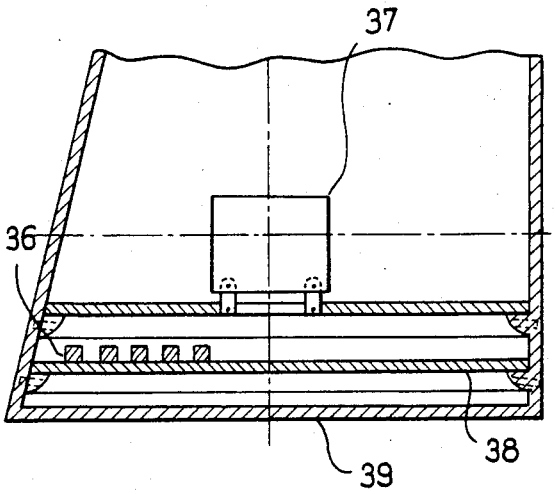
FIG. 7 shows, in cross section, the bottom of the cabin.
Figure 8:
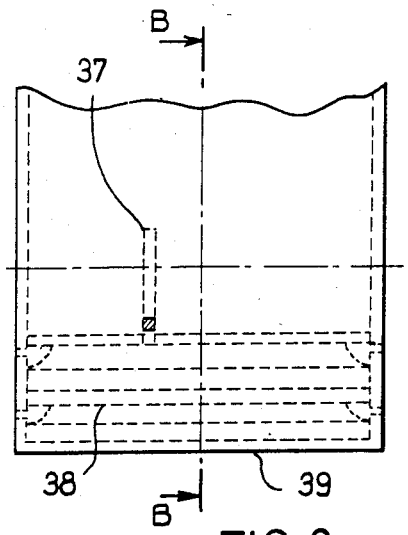
FIG. 8 shows, from the front, the bottom of the cabin.

(c) On the bottom of the cabin a stabilization system. In FIGS. 7 and 8, the cabin comprises at its bottom, a ballast 36 adapted to stabilize it.

this ballast is constituted by a lead casting or lead filings introduced through the trap door 37 of a deck disposed above another deck 38. This ballast rests precisely on this deck 38 supported by corner irons bolted to the walls.

A gap exists between the ballast support deck 38 and the cabin bottom deck 39.

(d) Specific shape of the cabin.

The cabin comprises, from the sea level, a wall 40 inclined at about 80° outwardly toward the deck 39.

the cabin has an open roof, it is surrounded at its upper part by profiles supporting plates of about 20 cm, which extend upwardly outwardly.

(e) Protection of the cabin.

the assembly of the cabin is protected in its movements by protective means which, from the projection of the supports cemented or bolted on the sides of the pontoon, extends the length of this pontoon or of the wharf if the installation is done in this manner.

a support reinforcement may be provided by a U-iron, bolted diagonally with a view toward long protection.

Although it has not yet happened, this station is without any doubt commercializable on a national and international scale. The output of the service rendered, compared to traditional processes, is three times as great for the consumer's expenditure.

The operational output of the station is directly connected to the owner's requirements to clean the hulls at least once a year. The excessive fuel consumption in the case of a dirty hull, the major advantage of good movement for sail boats whether or not they participate in regattas makes the station an indispensable complement for their enjoyment.

The industrial output is directly connected to the services rendered by the station. One can expect in the future substantial industrialization not only at the job creation level but also at the level of currency inflow, particularly if the material and the materials used are French.

I claim:

1. Autonomous station for cleaning submerged parts of floating bodies comprising a support independent of the floating body to be cleaned, and a semi-submerged cabin mounted for horizontal sliding movement on said support at a fixed height relative to said support, said cabin comprising a rigid frame having sides and a base sealed from the surrounding water and an open roof, said frame being so designed as to accommodate at least one operator, said cabin further comprising cleaning means for said submerged parts of floating bodies and operator-controlled means disposed within said cabin for effecting said horizontal sliding movement, said cleaning means comprising at least one tube for water under pressure mounted on sealed rotary bearings disposed on one of said sides of the cabin.

2. Autonomous station for cleaning submerged parts of floating bodies according to claim 1, wherein said operator-controlled means for effecting the horizontal displacement comprise grooved wheels secured to said cabin, rails fixed to said support and cooperating with said grooved wheels, and an operator-controlled set of pulleys and pinions to move said wheels along said guide rails.

3. Autonomous station for cleaning submerged portions of bodies according to claim 2, wherein said cabin comprises a rear side, and said set of pulleys and pinions comprises a pulley axle passing through said rear side through a fitting provided with a lubricator and has two internal grooves in which are disposed two O-rings.

4. Autonomous station for cleaning submerged parts of floating bodies according to claim 1, wherein said cabin comprises a forward side having at least two openings in which are mounted at least two said sealed rotary bearings, so as to ensure a complete sweeping of the surfaces to be treated of the floating body, by means of at least two said tubes for water under pressure.

5. Autonomous station for cleaning submerged portions of floating bodies according to claim 4, wherein said forward side comprises an exterior face, and the sealing of the cabin, at the exterior face, is effected by joints disposed between the flanges and the rotary bearing on the one hand and O-rings in grooves on the other hand, said O-rings permitting at the same time the sealing of the inward and outward movement of the tubes for water under pressure.

6. Autonomous station for cleaning submerged portions of floating bodies according to claim 4, wherein said forward side is inclined at about 80° to the deck.

7. Autonomous station for cleaning submerged portions of floating bodies according to claim 1, wherein said tubes are connected by reinforced conduits to a supply connection in the shape of a T or Y, said supply connection being connected to a reinforced feed conduit secured to a side.

8. Autonomous station for cleaning submerged portions of floating bodies according to claim 1, wherein said cabin comprises at its base a ballast passing through a trap door and disposed on a deck, itself supported by internal irons bolted on the sides of the cabin.

9. Autonomous station for cleaning submerged portions of floating bodies according to claim 8, wherein said cabin comprises a bottom deck that supports no weight and is disposed below the deck supporting the ballast.

10. Autonomous station for cleaning submerged portions of floating bodies according to claim 1, wherein said support comprises protective means for protecting the cabin in its movements, said protective means extending along the length of the support, from cemented or bolted supports.

11. Autonomous station according to claim 1, wherein said support is a floating pontoon immobilized by anchors deployed by means of winches.

12. Autonomous station according to claim 1, wherein said support is a wharf.

* * * * *